United States Patent [19]

Murphy

[11] Patent Number: 5,048,822

[45] Date of Patent: Sep. 17, 1991

[54] SIMULATED SPARRING APPARATUS AND METHOD

[76] Inventor: Richard A. Murphy, 112 Old Forge Rd., Millington, N.J. 07946

[21] Appl. No.: 583,606

[22] Filed: Sep. 17, 1990

[51] Int. Cl.[5] ..... A63B 69/00

[52] U.S. Cl. ..... 272/78; 272/76

[58] Field of Search ..... 272/76, 77, 78, 70.3, 272/70; 119/29

[56] References Cited

U.S. PATENT DOCUMENTS

| | | | |
|---|---|---|---|
| 4,147,344 | 4/1979 | Lee | 272/76 X |
| 4,345,755 | 8/1982 | Eidson | 272/78 |
| 4,721,302 | 1/1988 | Murphy | 272/78 |
| 4,911,428 | 3/1990 | Wiece | 272/78 |

FOREIGN PATENT DOCUMENTS

| | | | |
|---|---|---|---|
| 1304832 | 4/1987 | U.S.S.R. | 272/76 |

*Primary Examiner*—Richard J. Apley
*Assistant Examiner*—D. F. Crosby
*Attorney, Agent, or Firm*—Larson and Taylor

[57] ABSTRACT

A simulated sparring partner apparatus and method for the training and exercising of a boxer, including a track, a target article such as a punching bag suspended from the track, a drive for moving the punching bag along the track, and control apparatus for controlling the speed and direction of movement of the carriage along the track. The drive may move the punching bag at various speeds and in either direction. Also, the drive may be programmable such that the punching bag follows a predetermined path at predetermined speeds. Alternatively, motion of the punching bag may be manual so as to allow a coach or trainer to control the motion of the bag.

17 Claims, 3 Drawing Sheets

SIMULATED SPARRING APPARATUS AND METHOD

FIELD OF THE INVENTION

The present invention relates to the field of boxing, and in particular to an apparatus and method for simulating a sparring partner for boxing training.

BACKGROUND OF THE INVENTION

Various devices are known for aiding in the training and exercising of boxers. These include the well-known heavy punching bag and the smaller floor-mounted or ceiling-mounted punching bags.

Prior patented devices include Lewis U.S. Pat. No. 2,890,049 which describes a small punching bag designed to be mounted either to ceiling or a floor and Kauffman U.S. Pat. No. 4,627,611 and Klaudt U.S. Pat. No. 2,709,082 which show small punching bags designed for easy mounting.

However, since the mountings of these prior art devices are not moveable, they are of limited usefulness in training the boxer. A need therefore exists for an arrangement wherein the mounting of the device is movable, such that the device is movable to different positions, thereby providing a dynamic boxer training tool.

SUMMARY OF THE INVENTION

The purpose of the present invention is to fill this need of the prior art by providing a new apparatus and method which includes a target article such as a punching bag or the like for punching by a boxer, the mounting of which is capable of moving to different positions so to simulate a sparring partner.

This purpose of the present invention is achieved by providing a raised support structure means for defining a raised horizontal non-linear path. A target article such as a punching bag or the like is suspended from the support structure by engagement means such that the target article is essentially at the level to be punched by a boxer standing on a surface beneath the support structure, and such that movements of the engagement means along the path causes similar horizontal movements of the target article. A drive means is provided for moving the engagement means along the path, and hence effecting horizontal movements of the target article. The drive means may be movable at different speeds to vary movements of the target article to thereby simulate varying movements of a sparring partner.

In accordance with a preferred embodiment, the apparatus may include a control means for controlling the drive means to effect movements of the target article in different directions and at different speeds. Preferably, the control means comprises a computer having a memory including programs of selected predetermined movements of the drive means. This feature allows the movements of the target article to be preprogrammed.

Also, in accordance with a preferred embodiment, the raised support structure comprises a track. An engagement means comprises a carriage moveable along the track and driven by the drive means, with the target article being suspended from the engagement means. The track may comprise an endless path with a chain extending for the full length of the track. The carriage is connected to the chain to move therewith, and the track includes low friction means engaging and resting on a surface of the track for movement therealong. The drive means further comprises a motor for drivingly engaging the chain.

The endless path is preferably elongated or circular. The track may further comprise a channel having horizontal support surfaces, with the low friction means comprising rollers which roll on the horizontal support surfaces and, the chain also being supported by the horizontal support surfaces. The horizontal support surfaces include an opening extending for the complete length thereof for passage therethrough of a connection of the carriage to the suspended target article.

The present invention also comprises a method of training a boxer by artificially simulating a sparring partner, comprising suspending a target article such as a punching bag or the like in the path of the boxer at a height to be punched by the boxer and causing the target article to move horizontally along a predetermined non-linear path, including possibly changing the speed and direction of the target article, to thereby cause the target article to move in a manner which stimulates a sparring partner.

The method of the invention may also include preprogramming selected movements of the target article and moving the target article along the path forwardly and rearwardly and at varying speeds as determined by the program.

Thus, it is an object of this invention to provide a simulated sparring partner apparatus and method to assist in the training and exercising of a boxer.

Another object of the invention is to provide a method and apparatus for moving a target article such as a punching bag or the like along a track, capable of varied speed and direction.

Another object of the invention is to provide a moving target article such as a punching bag or the like such that the motion of the bag is manually controlled by a coach or trainer.

Another object of the invention is to provide a moving target article such as a punching bag or the like which is preprogrammable so to follow a predetermined course of motion.

These and other objects of the invention will become apparent from the detailed description to follow.

BRIEF DESCRIPTION OF THE DRAWINGS

Preferred embodiments of the present invention will now be described in detail with respect to the accompanying drawings, wherein.

DETAILED DESCRIPTION OF THE PREFERRED EMBODIMENTS

Figure 3:
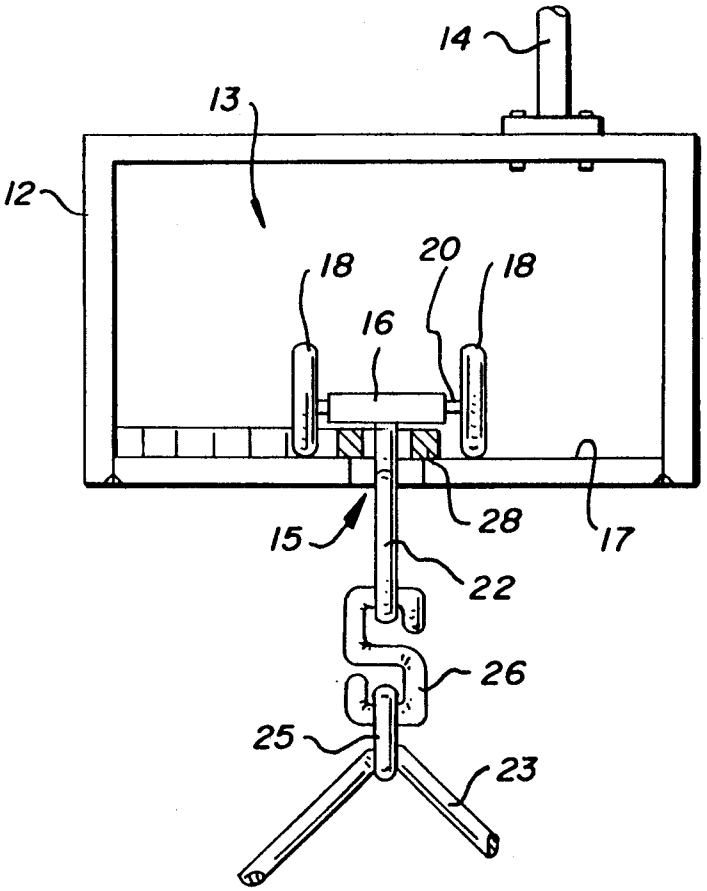
FIG. 3 is an enlarged partial cross-sectional view taken along line 3—3 of FIG. 2.

Referring now to the drawings, like elements are represented by like numerals throughout the several views.

Referring to FIGS. 1 to 4, the simulated sparring partner 10 includes a track 12 suspended from a ceiling (or any other high, sturdy support) by a rigid metal bar 14 bolted into the top or side of the track 12 and likewise bolted into a ceiling. Alternatively, in an embodiment not shown, the track may be suspended from a sturdy support having a plurality of legs.

The track 12 (preferably constructed of sturdy iron or steel) includes an interior channel 13 and forms a generally elongated or circular loop. The cross-section of the track 12, as shown in FIG. 3, generally comprises a rectangle with a narrow opening or slot 15 in the middle of the bottom leg of the rectangle. A carriage 16 is supported by the track 12 for conveyance within or along track 12. The carriage includes two sets of rollers 18 which engage the interior lower surface of track 12. Each set of rollers 18 comprises two opposing rollers joined by an axle 20. One or more vertical supports 22 depend from the center of the axle and protrude through the lower opening in the track 12. A target article such as a punching bag 24 is suspended from the vertical supports 22 by any suitable means such as an "S"-shaped hook 26, as shown. Punching bag 24 includes strap 23 and ring 25 (which straddles "S"-shaped hook 26). The track 12 is positioned at a height sufficiently high such that the center of the punching bag 24 is three to four feet above the floor or ground, such that a boxer may efficiently train using the punching bag. The track 12, metal bar 14, carriage 16 and hook 26 should be sufficiently sturdy and durable to support the weight of the punching bag 24 and withstand the stress resulting from long term training using the punching bag 24.

A chain 28 (such as a flat conveyor belt chain) is disposed within the interior of channel 13 of the track 12 and forms a closed loop spanning the entire length of interior channel 13. The carriage 16 also includes means for engaging the links in the chain 28 such that movement of the chain is imparted to the carriage. This can be accomplished, as shown in FIG. 3, by having the vertical support 22 protrude through a link in chain 28. Alternatively, any suitable hook or tab member can be employed to securely fix the carriage 16 to the chain 28. Chain 28 is sufficiently wide to straddle both sides of the slot.

Figure 1:
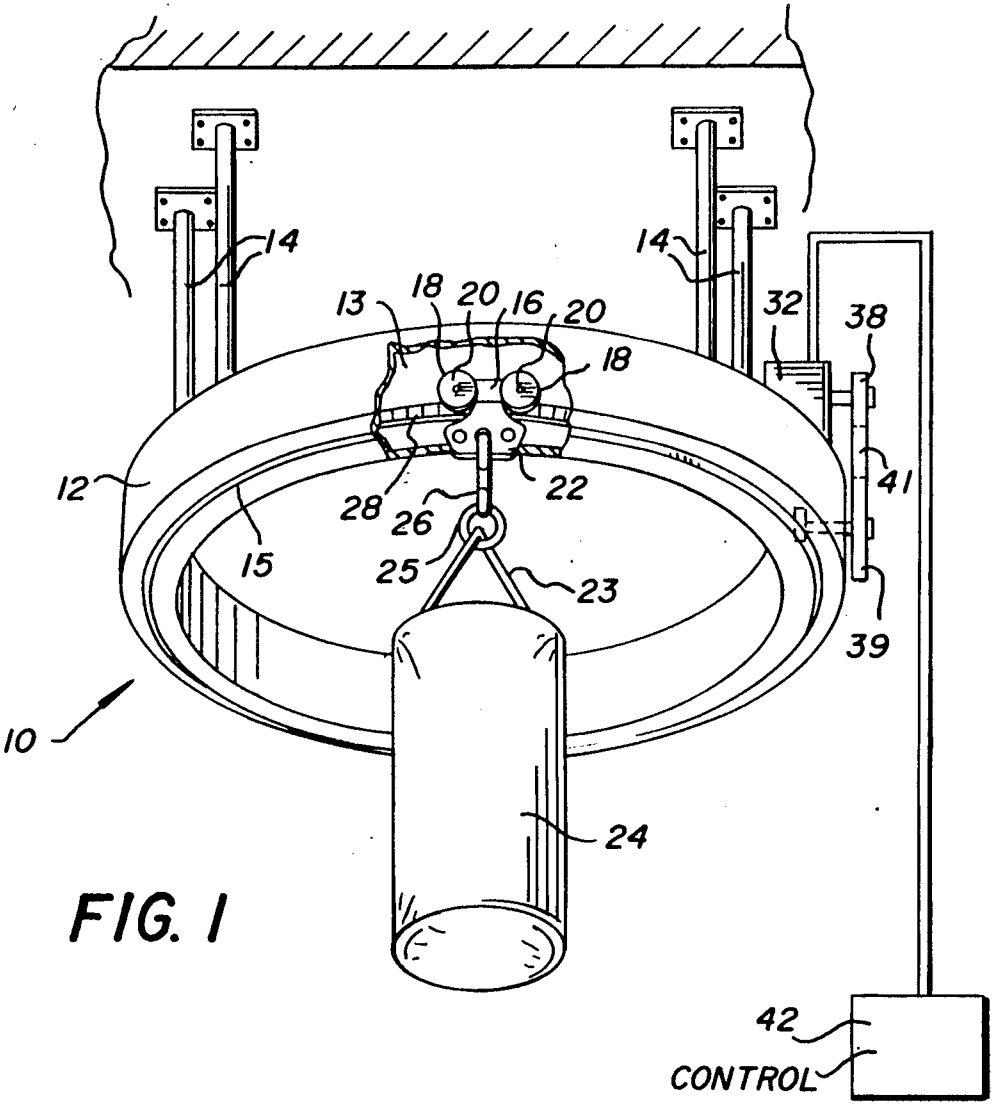
FIG. 1 is a perspective view of a preferred embodiment of the present invention, showing a circular track.
Figure 2:
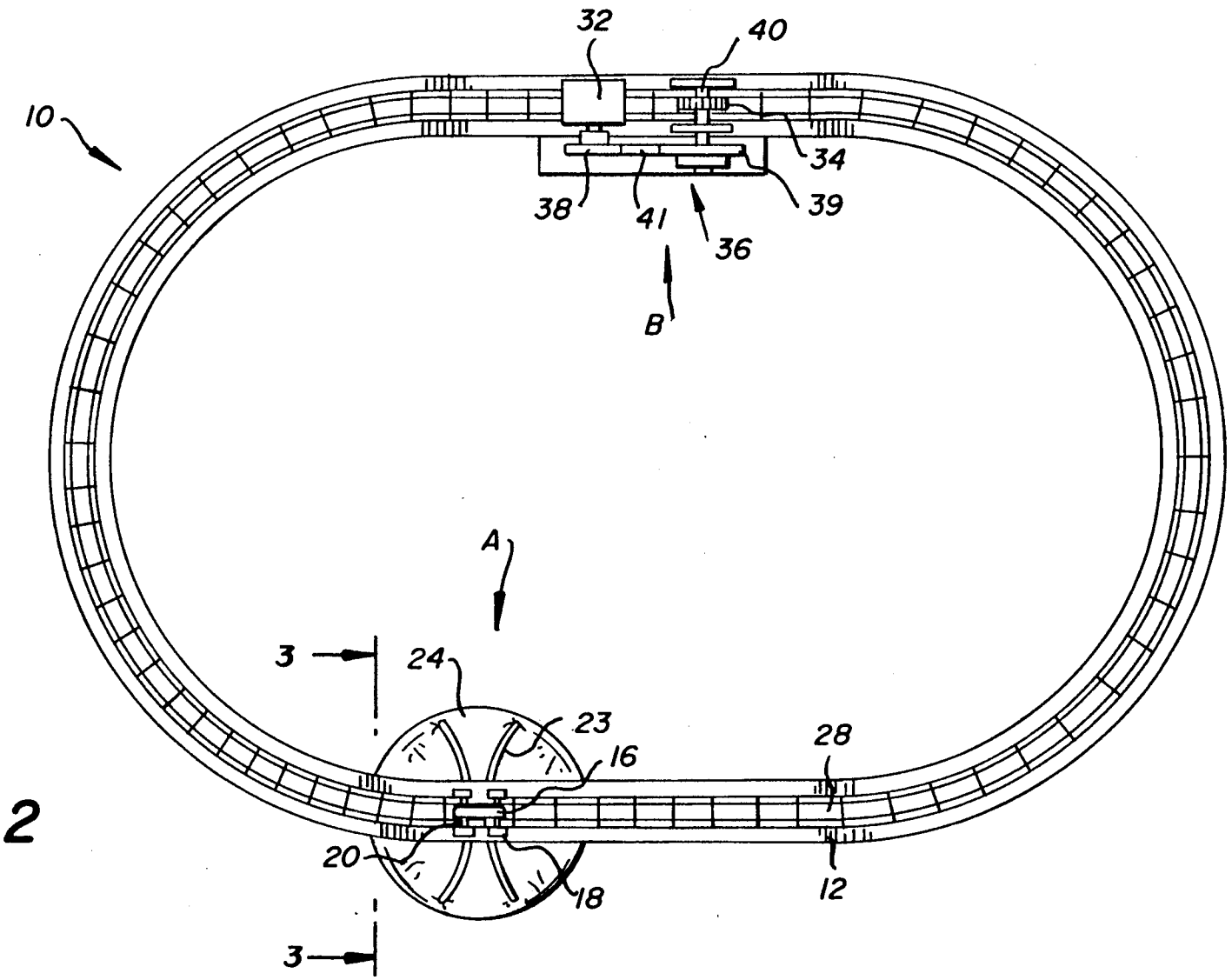
FIG. 2 is a plan view of another embodiment which is similar to FIG. 1 except that the track is elongated, and wherein the target article is at a different position from its position in FIG. 1.
Figure 4B:
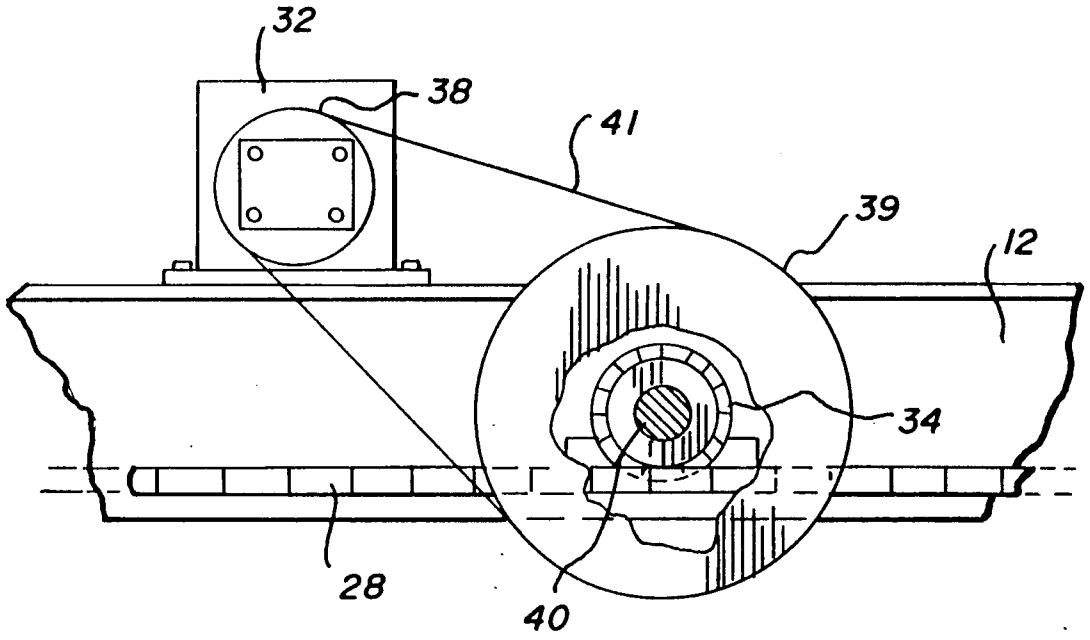
FIG. 4B is an enlarged side elevation view taken in the direction of arrow B in FIG. 2.
Figure 4A:
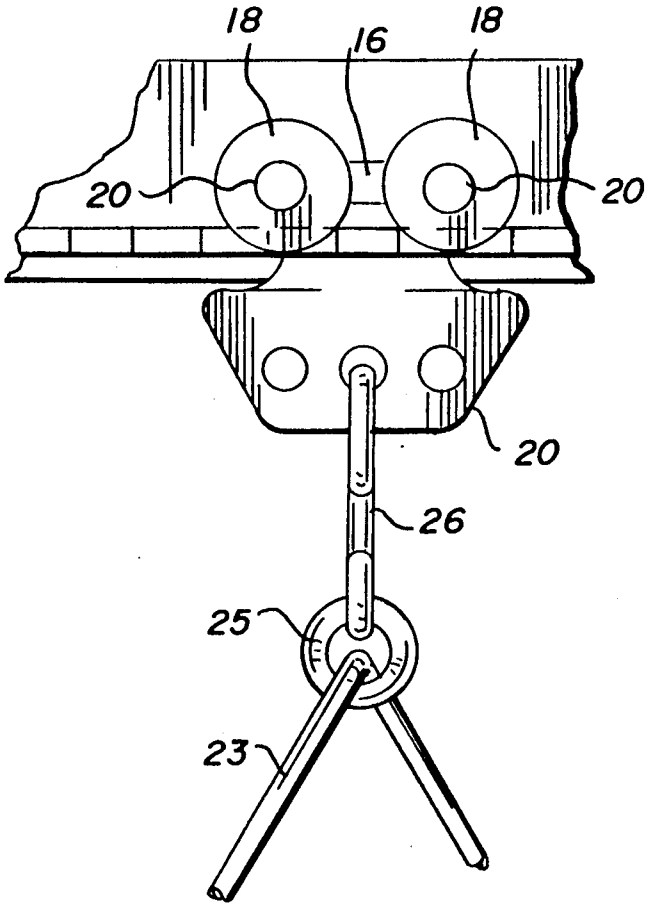
FIG. 4A is an enlarged side elevation view taken in the direction of arrow A in FIG. 2.

Drive means are provided which, in use, pull the chain within the track 12 at varying speeds, in either the clockwise or the counterclockwise direction. Referring to FIGS. 1 and 4B, the drive means comprises a variable speed motor 32 which drives a sprocket 34 via pulleys 38 and 39. As is shown more clearly in FIG. 4B, motor 32 is mounted to the top or side of track 12. A small pulley 38 is mounted to motor 32, a larger pulley 39 is mounted to track 12 (via a spindle 40), and a belt, chain, or band 41 connects the large and small pulleys. Spindle 40 is mounted transversely through track 12 for rotation about an axis perpendicular to chain 28. Also affixed to the spindle 40 is sprocket 34, positioned such that its cogs engage the links of chain 28. Therefore, in use, motor 32 (via the pulleys 38 and 39) rotates sprocket 34 which, in turn, engages chain 28 and pulls the chain within the track 12 thereby, moving suspended punching bag 24. In this manner, punching bag 24 can be drawn along the entire length of the track 12 at various speeds, and in either direction.

An opening is provided through the upper surface of track 12 in the vicinity of sprocket 34 and spindle 40 to allow the insertion of the various components which are, in use, disposed within the track.

A control mechanism shown schematically as 42 allows manual or automatic control of the speed and direction of the punching bag 24. Under manual control (which can be implemented with, for example, a "joystick" or other control device) a trainer or coach could directly control the speed and direction of the punching bag 24. Preferably, motor 32 is capable of at least three speeds—slow, medium and fast. The coach or trainer can thereby choose the speed and direction of the movement of bag 24 to maximize the efficiency of the training and exercise of the boxer. Movement of the bag 24 around track 12 preferably simulates the motion of a human sparring partner. Under automatic control (which can be implemented with, for example, a computer or microprocessor) automatic sparring partner 10 can be pre-programmed to follow a sequence of motions at various speeds. Thus, for example, simulated sparring partner 10 can be programmed to move punching bag 24 in the following sequence: alternating 30 seconds of fast clockwise motion and 30 seconds of fast counter-clockwise motion for a period of 20 minutes. Of course, any suitable sequence of motions can be chosen by the operator so to provide an efficient sparring workout. Two complete twenty minute sample workouts are provided in Tables I and II.

TABLE I

Sample Workout #1

Speed index 1 = slow 2 = med 3 = fast S = stop
Motion index F = forward R = reverse S = Stop

| ref | time | motion | speed | workout |
|---|---|---|---|---|
| 1. | 1 min. | S, F | S, 1 | 30 seconds of warm up bag in S. 30 seconds of half speed workout with bag in F + 1. |
| 2. | 3 min. | R, S, F | 2 | 1 min. full speed workout with bag in R + 2. 1 min. full speed workout with bag changing direction every 15 seconds in 2. 1 min. full speed workout with bag changing direction every 10 seconds stopping for 5 seconds in between changes. |
| 3. | 1 min. | F | 1 | 1 min. half speed workout with bag in F + 1. |
| 4. | 3 min. | F, S, R | 1, S, 3 | 1 min. full speed workout with bag in S. 1 min. full speed workout with bag in R + 3. 1 min. full speed workout with bag in R + S + 3 every 10 seconds. |
| 5. | 1 min. | F | 1 | Half speed workout with bag in F + 1. |
| 6. | 3 min. | S, F, S | 3 | Full speed workout with bag stopping and alternating direction every 15 seconds. |
| 7. | 1 min. | F | 1 | Half speed workout with bag in F + 1. |
| 8. | 3 min. | R, S, F | 2 | Repeat workout ref #2. |
| 9. | 1 min. | F | 1 | Half speed workout with bag in F + 1. |
| 10. | 3 min. | S, F, R | 3 | Repeat workout ref #6 |
| Total time | 20 minutes | | | |

TABLE II

Sample Workout #2 speed index 1 = slow 2 = med 3 = fast S = stop
motion index F = forward R = reverse S = Stop

| ref | time | motion | speed | workout |
|---|---|---|---|---|
| 1. | 1 min. | S | S | Warm up with alternating rotation |
| 2. | 3 min. | S, F, R | 3 | Full speed workout with boxer adjusting to bag movement, 45 seconds of F. 15 seconds of S. 10 seconds of F with quick R of 50 seconds, stop and go F each for 15 seconds adding up to a minute. |
| 3. | 1 min. | F, R | 1 | Half speed workout with bag alternating every 10 seconds for total of one minute. |
| 4. | 3 min. | S, F, R | 1, 2, 3 | Full speed workout with varying bag speeds, 1 min. of 1 speed F. 1 min. of 3 speed R. 1 min. of 2 speed F + R every 15 seconds. |
| 5. | 1 min. | S | S | Half speed with alternating rotation |
| 6. | 3 min. | S, F, R | 3 | Repeat workout ref #2. |
| 7. | 1 min. | S | S | Repeat of ref. #5. |
| 8. | 3 min. | S, F, R | 1, 2, 3 | Repeat workout ref #4. |
| 9. | 1 min. | F | 1 | Repeat workout ref #5. |
| 10. | 3 min. | R, F | 2 | Full speed workout with bag changing direction every 20 seconds. |

Total time 20 minutes

The invention has been described with respect to preferred embodiments. However it will be understood that variations and modifications can be effected within the spirit and scope of the invention, as set forth in the appended claims.

I claim:

1. An apparatus for simulating a sparring partner for a boxer, comprising:

a raised support structure means defining a raised horizontal non-linear path, a target article suspended from the support structure by engagement means such that the target article is essentially at the level to be punched by a boxer standing on a surface beneath the support structure, and such that movement of the engagement means along said path causes similar horizontal movements of the target article, drive means for moving the engagement means along said path, and hence effecting horizontal movement of the target article, said drive means being movable at different speeds to vary movements of the target article to thereby simulate varying movements of a sparring partner.

2. The apparatus of claim 1, including a control means for controlling the drive means to effect movements of the target article in different directions and at different speeds.

3. The apparatus of claim 2, said control means being a computer, the memory of which includes programs of selected predetermined movements of the drive means, and hence also of the target article.

4. The apparatus of claim 1, said raised support structure comprising a track, the engagement means being a carriage moveable along the track and driven by the drive means, the target article suspended from the carriage.

5. The apparatus of claim 4, said track being an endless path, a chain extending for the full length of said track, the carriage connected to the chain to move therewith, and said carriage including low friction means engaging and resting on a surface of the track for movement therealong, the drive means being a motor drivingly engaging said chain.

6. The apparatus of claim 5, the endless path being elongated.

7. The apparatus of claim 5, the endless path being circular.

8. The apparatus of claim 5, the track being a channel having horizontal support surfaces, the low friction means comprising rollers which roll on the horizontal support surface, the chain also supported by horizontal support surface, the horizontal support surface having an opening for the complete length thereof for passage therethrough of a connection of the carriage to the suspended target article.

9. An apparatus for simulating a sparring partner for a boxer, comprising a raised support structure means defining a raised horizontal non-linear path, a target article suspended from the support structure by engagement means such that the target article is essentially at the level to be punched by a boxer standing on a surface beneath the support structure, and such that movement of the engagement means along said path causes similar horizontal movements of the target article, drive means for moving the engagement means along said path, and hence effecting horizontal movement of the target article, said drive means being movable at different speeds and in different directions to vary movements of the target article to thereby simulate varying movements of a sparring partner; including a control means for controlling the drive means to effect movements of the target article in different directions and different speeds; said control means being a computer, the memory of which includes programs of selected predetermined movements of the drive means, and hence also of the target article; said raised support structure comprising a track, the engagement means being a carriage moveable along the track and driven by the drive means, the target article suspended from the carriage.

10. The apparatus of claim 9, said track being an endless path, a chain extending for the full length of said track, the carriage connected to the chain to move therewith, and said carriage including low friction means engaging and resting on a surface of the track for movement therealong, the drive means being a motor drivingly engaging said chain.

11. A method of training a boxer by artificially simulating a sparring partner, comprising the steps of:

suspending a target article in the path of the boxer at a height to be punched by the boxer, utilizing control means to cause the target article to move horizontally along a predetermined non-linear path, including changing the speed and direction of the target article, to thereby cause the target article to move in a manner which simulates a sparring partner.

12. The method of claim 11, including preprogramming the control means to provide selected movements of the target article and effecting movements by said programs.

13. The method of claim 11, including moving the target article along the path forwardly and rearwardly and at varying speeds.

14. The method of claim 13, wherein the control means is programmable and a program provides said movements.

15. The method of claim 11, the path being an endless path.

16. The method of claim 15, the endless path being elongated.

17. The method of claim 15, the endless path being circular.

* * * * *